US009234723B2

(12) United States Patent
De Picciotto

(10) Patent No.: US 9,234,723 B2
(45) Date of Patent: Jan. 12, 2016

(54) METHOD FOR AUTOMATICALLY MANAGING A HOMING DEVICE MOUNTED ON A PROJECTILE, IN PARTICULAR ON A MISSILE

(75) Inventor: Francois De Picciotto, Paris (FR)

(73) Assignee: MBDA FRANCE, Paris (FR)

( * ) Notice: Subject to any disclaimer, the term of this patent is extended or adjusted under 35 U.S.C. 154(b) by 0 days.

(21) Appl. No.: 14/113,519

(22) PCT Filed: Apr. 16, 2012

(86) PCT No.: PCT/FR2012/000146

§ 371 (c)(1),
(2), (4) Date: Oct. 28, 2013

(87) PCT Pub. No.: WO2012/146835

PCT Pub. Date: Nov. 1, 2012

(65) Prior Publication Data

US 2014/0042265 A1 Feb. 13, 2014

(30) Foreign Application Priority Data

Apr. 28, 2011 (FR) ..... 11 01320

(51) Int. Cl.
*F41G 7/22* (2006.01)
*F41G 7/00* (2006.01)

(52) U.S. Cl.
CPC .. *F41G 7/00* (2013.01); *F41G 7/22* (2013.01); *F41G 7/2253* (2013.01); *F41G 7/2293* (2013.01)

(58) Field of Classification Search
CPC ..... F41G 7/00; F41G 7/20; F41G 7/22; F41G 7/2253; F41G 7/2273; F41G 7/2286; F41G 7/2293
USPC ..... 244/3.1, 3.15–3.19; 342/61, 62; 250/200, 201.1, 203.1, 203.3, 203.6, 250/216, 234, 235, 236; 343/700 R, 720, 343/753, 754; 356/138, 140, 141.2, 141.5
See application file for complete search history.

(56) References Cited

U.S. PATENT DOCUMENTS

| | | | | | |
|---|---|---|---|---|---|
| 3,114,149 | A | * | 12/1963 | Jessen, Jr. | 343/720 |
| 3,161,375 | A | * | 12/1964 | Ruhge | 356/141.5 |
| 3,756,538 | A | * | 9/1973 | McLean | 244/3.16 |
| 3,844,506 | A | * | 10/1974 | Stavis et al. | 244/3.15 |
| 3,902,685 | A | * | 9/1975 | Alpers | 244/3.19 |
| 3,951,358 | A | * | 4/1976 | DeLano et al. | 244/3.15 |
| 3,954,228 | A | * | 5/1976 | Davis, Jr. | 244/3.16 |
| 3,979,755 | A | * | 9/1976 | Sandoz et al. | 343/754 |
| 4,004,754 | A | * | 1/1977 | Cox et al. | 244/3.16 |
| 4,009,393 | A | * | 2/1977 | Ashley et al. | 244/3.16 |
| 4,030,807 | A | * | 6/1977 | Briney | 244/3.16 |
| 4,158,845 | A | * | 6/1979 | Pinson | 244/3.16 |
| 4,176,814 | A | * | 12/1979 | Albrektsson et al. | 244/3.15 |

(Continued)

*Primary Examiner* — Bernarr Gregory
(74) *Attorney, Agent, or Firm* — Duane Morris LLP; J. Rodman Steele, Jr.; Gregory M. Lefkowitz

(57) ABSTRACT

According to the invention, the projectile (1) is provided with a strapdown homing device (2), said device having a lock-on phase during which the latter attempts to detect a target (C), and including an viewing direction (3), said viewing direction (3) being fixed with respect to the projectile (1) and extending along the longitudinal axis (4) of the latter, said projectile (1) further comprising control means (8) for automatically controlling said projectile (1) so as to cause the longitudinal axis (4) thereof, in flight and during the lock-on phase of the homing device (2), to trace a circle, the radius of which increases in time, until the target (C) is detected.

15 Claims, 1 Drawing Sheet

(56) References Cited

U.S. PATENT DOCUMENTS

| | | | | | |
|---|---|---|---|---|---|
| 4,195,799 | A | * | 4/1980 | Sogo et al. | 244/3.13 |
| 4,347,996 | A | * | 9/1982 | Grosso | 244/3.16 |
| 4,413,177 | A | * | 11/1983 | Godwin et al. | 244/3.16 |
| 4,427,878 | A | * | 1/1984 | Buchtel et al. | 250/203.1 |
| 4,521,782 | A | * | 6/1985 | Pinson | 244/3.16 |
| 4,643,373 | A | * | 2/1987 | Adams | 244/3.19 |
| 4,679,748 | A | * | 7/1987 | Blomqvist et al. | 244/3.19 |
| 4,711,413 | A | | 12/1987 | Stessen | |
| 4,999,491 | A | * | 3/1991 | Semler et al. | 250/236 |
| 5,061,930 | A | * | 10/1991 | Nathanson et al. | 244/3.19 |
| 5,088,659 | A | * | 2/1992 | Neff et al. | 244/3.16 |
| 5,456,179 | A | * | 10/1995 | Lamelot | 244/3.16 |
| 5,647,560 | A | | 7/1997 | Schnatz et al. | |
| 5,779,187 | A | * | 7/1998 | Dulat et al. | 244/3.16 |
| 6,121,606 | A | * | 9/2000 | Voigt et al. | 244/3.16 |
| 6,180,945 | B1 | * | 1/2001 | Barton et al. | 244/3.16 |
| 6,198,564 | B1 | * | 3/2001 | Knight | 244/3.16 |
| 6,626,834 | B2 | * | 9/2003 | Dunne et al. | 244/3.16 |

* cited by examiner

METHOD FOR AUTOMATICALLY MANAGING A HOMING DEVICE MOUNTED ON A PROJECTILE, IN PARTICULAR ON A MISSILE

CROSS-REFERENCE TO RELATED APPLICATIONS

This application is a §371 national stage entry of International Application No. PCT/FR2012/000146, filed Apr. 16, 2012, which claims priority to French Patent Application No. 1101320 filed Apr. 28, 2011, the entire contents of which are incorporated herein by reference.

The present invention relates to a method for automatically managing a strapdown homing device, which is mounted on a projectile, and a projectile, in particular an air missile, which is provided with a homing device of this type.

A "strapdown" homing device conventionally has a fixed viewing direction, which is associated with the axes of the projectile on which it is mounted.

It is known that a conventional missile homing device represents a very significant portion of the total cost of said missile and may be the most costly portion (sometimes up to half of the cost) due in particular to the complexity of the optics orientation mechanisms, to the detailed information required for this orientation and to the control thereof.

Because it has no need for these mechanisms, a "strapdown" homing device allows the cost thereof to be greatly reduced (usually by a factor of 3 to 10), which justifies the relevance of this type of homing device in particular on a low-cost missile. The field of view of a strapdown homing device is usually greater than that of a conventional homing device with orientable optics to allow the missile to continue to "see" the target regardless of the angle of incidence or angle of sideslip adopted by the missile, and regardless of the speed of the target.

For a LOAL (Lock-On After Launch) missile for which, by definition, the homing device locks onto the target after launch, the missile still does not "see" the target at the beginning of the mission. The mission begins with a guiding or "mid-course" phase, of which the purpose is to take the missile close enough to the target for said target to then be detected by the homing device (lock-on). However, a plurality of phenomena can lead, independently or jointly, to the target being absent from the field of view of the homing device during this phase provided for locking on (and thus result in the failure of the mission):

- a drift in the navigation of the projectile, in both position and attitude. In this case, the projectile does not arrive at the place it is meant to arrive at and/or it is poorly oriented and does not "see" the target;
- a movement of the target. The target may move and no longer be in the viewing zone of the homing device at the end of the mid-course phase.

These two phenomena therefore limit the range of the missile.

A plurality of solutions is known to make the lock-on phase more resistant to these two phenomena of drift and target movement (which of course allows the acceptable duration of the mid-course phase, and therefore the range and capabilities of the missile, to be increased). The following solutions in particular can be cited:

a) increasing the field size of the homing device or its range, which makes earlier detection possible and therefore supposes fewer errors or movements of the target to overcome;

b) improving navigational capabilities to reduce the term of inertial drift error; and c) providing the missile with a data transmission link for updating the coordinates of the target and reducing the error due to said target.

However, these different conventional solutions have drawbacks. In particular:

a) at isocost, the field size of the homing device is increased to the detriment of range and precision, and reciprocally, any improvement gained on one of the parameters is paid for by the others, limiting (or even cancelling out) the advantage of this solution, unless the general quality of the sensor is improved, which raises the problem of cost as well as technological capability. Because of the constraints induced by the use of a strapdown homing device, the field required is already large (and therefore has low precision), and it becomes even more difficult to extend it further (the problem of the optics space requirements, precision of the distance sensing generated);

b) with regard to improving navigational capabilities to reduce the term of inertial drift error, over and above the possible cost problem of this solution (if an additional sensor is added (for example GPS) or a better navigation unit is chosen), only some of the errors are corrected in this way. Moreover, any movement of the target is not addressed; and c) with regard to equipping the missile with a data transmission link to update the coordinates of the target, this solution raises problems of cost, space requirements in the missile and operational capacity (system constraint), nor does it allow errors due to navigational drift to be corrected.

These conventional solutions are therefore not entirely satisfactory.

BRIEF SUMMARY OF THE INVENTION

The object of the present invention is to overcome these drawbacks. The invention relates to a method for automatically managing a strapdown homing device, which is mounted on a projectile, in particular an air missile, which has a lock-on phase during which it tries to detect a target and which comprises a viewing direction, said viewing direction being fixed relative to the projectile and being directed along the longitudinal axis thereof, said management method allowing the target detection (lock-on) capabilities to be increased, regardless of the nature of any error (navigational error or error due to the movement of the target), without requiring any sensor or additional cost.

Therefore, according to the invention, said method is remarkable in that said projectile is controlled (or guided) automatically so as to cause a circle, the radius of which increases over time, to be traced at the longitudinal axis of said projectile, during the lock-on phase of the homing device, until the target is detected.

Thus, through this control of the projectile designed to cause it to trace an increasing circle about its direction of flight, the area swept by the homing device during the lock-on phase is increased, the viewing direction of which is fixed along the longitudinal axis of the projectile. Consequently, the target detection capabilities are increased considerably, regardless of the nature of a possible error (navigational error or error due to the movement of the target), without requiring any sensor or additional cost.

The invention can be applied to any type of LOAL strapdown homing device of which the lock-on (viewing and following the target) takes place after firing, with no other constraint (range, usage concept, etc.) and in particular to a low-cost air-to-ground missile.

Advantageously, the initial control amplitude depends on the field of the homing device, and is for example equal to the half-field of said homing device.

In a preferred embodiment, the projectile is subjected to two controls designed to cause a variation on the one hand of the angle between a direction vector associated with the longitudinal axis of the projectile and a first projectile axis and on the other hand of the angle between said direction vector and a second projectile axis, respectively, these two projectile axes defining a plane which is perpendicular to the longitudinal axis of the projectile, and these two controls are such that said angular variations are sinusoidal and shifted by $\pi/2$. The entire projectile is therefore imprinted with an oscillatory movement of its axis, to allow the homing device to sweep a viewing zone that is considerably greater than just the viewing field thereof.

Advantageously, the period of said sinusoidal angular variations increases slightly over time to allow the projectile to widen the search zone.

The present invention also relates to a projectile, in particular an air missile, provided with a strapdown homing device, which has a lock-on phase during which it tries to detect a target and which comprises a viewing direction, said viewing direction being fixed relative to the projectile and being directed along the longitudinal axis thereof.

According to the invention, said projectile is remarkable in that it comprises automatic control means for controlling (or guiding) said projectile so as to cause a circle, the radius of which increases over time, to be traced at the longitudinal axis thereof, in flight and during the lock-on phase of the homing device, until the target is detected.

In a preferred embodiment, said automatic control means are formed so as to subject the projectile simultaneously to two controls designed to cause a variation on the one hand in the angle between the direction vector associated with the longitudinal axis of the projectile and a first projectile axis and on the other hand in the angle between said direction vector and a second projectile axis, respectively, these two projectile axes defining a plane which is perpendicular to the longitudinal axis of the projectile, and these two controls are such that said angular variations are sinusoidal and shifted by $\pi/2$.

Moreover, advantageously, said automatic control means form part of an automatic control system of said projectile, which conventionally comprises all the means necessary to cause the projectile to fly and to guide it.

BRIEF DESCRIPTION OF THE DRAWINGS

The figures of the accompanying drawings will clarify how the invention can be implemented. In these figures, identical reference signs refer to similar elements.

DETAILED DESCRIPTION OF THE INVENTION

Figure 1:
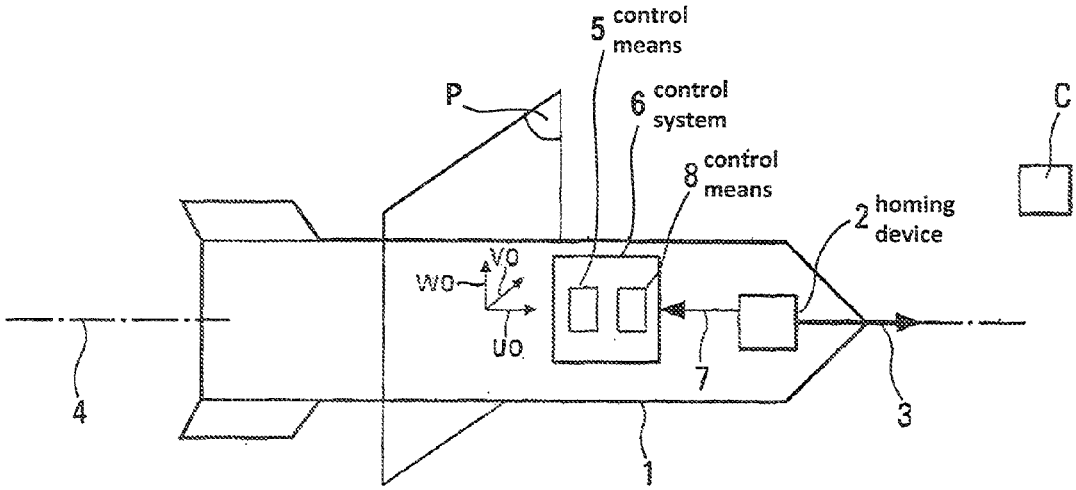
FIG. 1 shows highly schematically a missile provided with a homing device, to which the present invention is applied.

The present invention is applied to a projectile 1, in particular an air missile, shown schematically in FIG. 1, and is designed for managing the operation of a strapdown homing device 2, which is mounted on said projectile 1.

Conventionally, a homing device 2 of this type has a lock-on phase during which it tries to detect a target C, in particular a moving target. Said homing device 2 has a viewing direction 3 which is fixed relative to the projectile 1 and is directed along the longitudinal axis 4 thereof.

Said projectile 1 comprises conventional control means 5 which form part of a conventional control system 6 (linked by a connection 7 to the homing device 2 and shown highly schematically in FIG. 1) and which comprise all the elements necessary to guide and control the projectile 1 so that it can reach a target C, which is usually moving. These control means 5 comprise in particular data processing means which automatically produce guidance orders allowing the projectile 1 to follow a trajectory for intercepting the target C and guidance means (not shown) such as control surfaces or any other type of known elements, which automatically apply these guidance orders to the projectile 1. All these conventional means (of the system 6) are well known and will not be described further below.

Preferably, said projectile 1 is a LOAL (Lock-On After Launch) missile for which, by definition, the homing device 2 locks onto the target C after launch. Said missile does not "see" the target C at the beginning of the mission. Conventionally, the mission begins with a guiding or "mid-course" phase, of which the purpose is to take said missile close enough to the target C for said target to then be detected by the homing device 2.

According to the invention, said projectile 1 also comprises automatic control means 8 for controlling (or guiding) said projectile 1 so as to cause a circle, the radius of which increases over time, to be traced at the longitudinal axis 4 of said projectile 1, in flight and during the lock-on phase of the homing device 2 (in other words during the search for the target C). This control is applied until the target C is detected. Thus, owing to the invention, the projectile 1 is guided and controlled in a conventional trajectory by the means 5, to which conventional guiding and control the control applied by the control means 8 is added to cause the projectile 1 to trace an increasing circle about its direction of flight.

Thus, through this control of the projectile 1 designed to cause it to trace an increasing circle, the zone viewed by the homing device 2 during the lock-on phase is increased. The homing device 2 is able to sweep a viewing zone which is much larger than merely its fixed-dimension field of view. Consequently, the capabilities of the homing device 2 to detect the target C are considerably increased, regardless of the nature of any error (navigational error or error due to the movement of the target), without requiring any sensor or additional cost.

In a preferred embodiment, said automatic control means 8 form part of said automatic control system 6, which conventionally comprises all the means necessary to cause the projectile 1 to fly and to guide it towards a target C.

The trihedron (pitch, yaw and roll axis) ($\overrightarrow{uo}, \overrightarrow{vo}, \overrightarrow{wo}$) defined by the projectile axes at the time when application of the guiding control is to begin is considered. As shown in FIG. 1, the two projectile axes ($\overrightarrow{vo}$) and ($\overrightarrow{wo}$) define a plane P which is perpendicular to the longitudinal axis 4 of the projectile 1. (u') is considered the direction vector which is associated with the longitudinal axis 4 of the projectile 1, while the angle ($\overrightarrow{vo}, \overrightarrow{u}$) is defined as $\alpha v$ and the angle ($\overrightarrow{wo}, \overrightarrow{u'}$) is defined as $\alpha w$. These two angles satisfy the following equations: $\alpha v$=arcsin) ($\overrightarrow{u'}, \overrightarrow{vo}$) and $\alpha w$=arcsin ($\overrightarrow{u'}, \overrightarrow{wo}$).

The purpose of the control means 8 is to cause these two angles $\alpha v$ and $\alpha w$ to vary.

Figure 2:
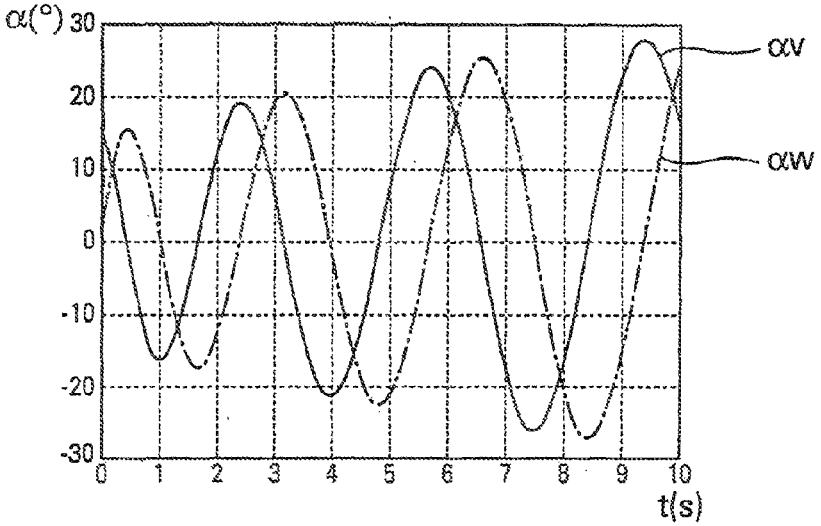
FIG. 2 is a graph explaining the features of a preferred missile control mode.

As the principle according to the invention is to cause a circle with a radius that increases over time to be traced at the projectile axis, the controls generated by the control means 8 to obtain said angular variations are sinusoidal and shifted by $\pi/2$, as shown in FIG. 2, which shows the angular variations $\alpha$ (expressed in °) as a function of time t (expressed in seconds) for $\alpha v$ and $\alpha w$. Moreover, the maximum values of $\alpha v$ and $\alpha w$ increase at each half-period.

The amplitude of the angular control is preferably initially close to the value of the field of view of the homing device 2 (and may in particular be equal to the half-field thereof, for example 15°), which provides cover for a large angular zone, without creating a dead zone at the centre.

The period is chosen depending on the necessary duration for viewing the zone to ensure that the target C is detected, and is only given as an example in FIG. 2. It can also increase slowly over time to give the projectile 1 the opportunity to widen the search zone if a first pass is unsuccessful.

The present invention, which therefore widens the search zone, allows both the impact of navigational drift and the impact of movement of the target C to be reduced, and not (as in the conventional solutions mentioned above) only one of these two phenomena.

Moreover, it provides a significant advantage in that, for a homing device to which the present invention has been applied, lock-on performance equivalent to that of a homing device with greater capabilities (same range and precision, but a field of 48° instead of 33°) has been observed.

The invention claimed is:

1. Method for automatically managing a strapdown homing device (2), which is mounted on a guided projectile (1), wherein said homing device executes a detection phase until a target (C) is detected, wherein said detection phase comprises utilizing a viewing direction (3), said viewing direction (3) being fixed relative to the guided projectile (1) and being directed along the longitudinal axis (4) thereof, wherein a field of view during the detection phase is around the longitudinal axis (4) of said projectile (1), wherein the guided projectile (1) is subjected simultaneously to two controls designed to cause a variation on the one hand in the angle ($\alpha v$) between a direction vector associated with the longitudinal axis of the guided projectile and a first projectile axis, and on the other hand in the angle ($\alpha w$) between said direction vector and a second projectile axis, respectively, these two projectile axes defining a plane (P) which is perpendicular to the longitudinal axis (4) of the guided projectile (1), and the two controls are such that said angular variations ($\alpha v$, $\alpha w$) are oscillatory.

2. Method according to claim 1, wherein said angular variations ($\alpha v$, $\alpha w$) are sinusoidal.

3. The method according to claim 1, wherein the guided projectile is an air missile.

4. The method according to claim 1, wherein said angular variations ($\alpha v$, $\alpha w$) are sinusoidal and shifted by $\pi/2$ in order to trace a circular field of view.

5. The method according to claim 4, wherein said angular variations ($\alpha v$, $\alpha w$) increase over time.

6. The method according to claim 1, wherein said angular variations ($\alpha v$, $\alpha w$) increase over time.

7. A guided projectile provided with a strapdown homing device (2), wherein said homing device executes a detection phase during flight until a target (C) is detected, wherein said detection phase comprises utilizing a viewing direction (3), said viewing direction (3) being fixed relative to the guided projectile (1) and being directed along the longitudinal axis (4) thereof, wherein said homing device comprises automatic control means (8) for automatically controlling said guided projectile (1), wherein said automatic control means (8) are formed so as to subject the guided projectile (1) simultaneously to controls designed to cause a variation on the one hand in the angle ($\alpha v$) between a direction vector associated with the longitudinal axis of the guided projectile and a first projectile axis and on the other hand in the angle ($\alpha w$) between said direction vector and a second projectile axis, respectively, these two projectile axes defining a plane (P) which is perpendicular to the longitudinal axis (4) of the guided projectile (1), and in that these two controls are such that said angular variations ($\alpha v$, $\alpha w$) are oscillatory.

8. A guided projectile according to claim 7, wherein said angular variations ($\alpha v$, $\alpha w$) are sinusoidal.

9. A guided projectile according to claim 7, wherein said automatic control means (8) form part of an automatic control system (6) of said guided projectile (1).

10. A guided projectile according to claim 7, wherein the guided projectile is an air missile.

11. The guided projectile according to claim 7, wherein said angular variations ($\alpha v$, $\alpha w$) are sinusoidal and shifted by $\pi/2$ in order to trace a circular field of view.

12. The guided projectile according to claim 11, wherein said angular variations ($\alpha v$, $\alpha w$) increase over time.

13. The guided projectile according to claim 7, wherein said angular variations ($\alpha v$, $\alpha w$) increase over time.

14. A guided projectile provided with a strapdown homing device (2), wherein said homing device executes a detection phase during flight until a target (C) is detected, wherein said detection phase comprises utilizing a viewing direction (3), said viewing direction (3) being fixed relative to the guided projectile (1) and being directed along the longitudinal axis (4) thereof, wherein said homing device comprises automatic control means (8) for automatically controlling said guided projectile (1), wherein said automatic control means (8) are formed so as to subject the guided projectile (1) to controls designed to cause a variation on an angle ($\alpha v$) between a direction vector associated with the longitudinal axis of the guided projectile and a first projectile axis, wherein the first projectile axis is perpendicular to the longitudinal axis (4) of the guided projectile (1), wherein the controls are such that said angular variation ($\alpha v$) is oscillatory.

15. The guided projectile according to claim 14, wherein said angular variation ($\alpha v$) increases over time.

* * * * *